United States Patent [19]

Borrousch et al.

[11] Patent Number: 4,977,946

[45] Date of Patent: Dec. 18, 1990

[54] DIFFERENTIAL PRESSURE, COUNTERGRAVITY CASTING OF INDIVIDUAL CHARGES OF MELT FROM A CASTING BASIN

[75] Inventors: Eugene W. Borrousch; Frank R. Green, both of Saginaw, Mich.

[73] Assignee: General Motors Corporation, Detroit, Mich.

[21] Appl. No.: 529,236

[22] Filed: May 25, 1990

[51] Int. Cl.[5] ..... B22D 18/06; B22D 27/20

[52] U.S. Cl. ..... 164/57.1; 164/63; 164/130; 164/133; 164/255; 164/335

[58] Field of Search ..... 164/55.1, 56.1, 57.1, 164/58.1, 63, 119, 130, 133, 255, 306, 335

[56] References Cited

U.S. PATENT DOCUMENTS

| | | | |
|---|---|---|---|
| 3,703,922 | 11/1972 | Dunks et al. | 164/57.1 |
| 3,900,064 | 8/1975 | Chandley et al. . | |
| 4,010,876 | 3/1977 | Steinemann | 164/55.1 X |
| 4,340,108 | 7/1982 | Chandley et al. | 164/63 |
| 4,431,046 | 2/1984 | Phillips | 164/130 X |
| 4,436,142 | 3/1984 | Mather | 164/55.1 X |
| 4,606,396 | 8/1986 | Chandley et al. | 164/255 |

FOREIGN PATENT DOCUMENTS

| | | | |
|---|---|---|---|
| 55-48466 | 4/1980 | Japan | 164/55.1 |
| 56-158253 | 12/1981 | Japan | 164/58.1 |
| 59-150654 | 8/1984 | Japan . | |

*Primary Examiner*—Richard K. Seidel
*Assistant Examiner*—J. Reed Batten, Jr.
*Attorney, Agent, or Firm*—Reising, Ethington, Barnard, Perry & Milton

[57] ABSTRACT

A charge of melt in an amount sufficient to cast only one mold is admitted to a casting basin from a melt-holding chamber. A casting mold is immersed in the freshly admitted charge and the charge is counter-gravity cast into the mold by establishing a suitable differential pressure between the mold and the charge. After casting, insufficient charge is left in the casting basin to cast the next mold whereupon the casting basin is supplied with the next fresh charge of the melt for casting the next mold. In this way, a fresh charge of melt is cast into each mold in a series of molds. Each charge of melt may be treated (e.g. nodularized) in-situ in the casting basin such that each mold is filled with a freshly treated (nodularized) charge of melt having an effective concentration of the alloyant therein.

12 Claims, 2 Drawing Sheets

DIFFERENTIAL PRESSURE, COUNTERGRAVITY CASTING OF INDIVIDUAL CHARGES OF MELT FROM A CASTING BASIN

FIELD OF THE INVENTION

This invention relates to the differential pressure, countergravity casting of a melt by admitting a plurality of individual, fresh charges of the melt in succession to a casting basin and countergravity casting each charge into a respective mold in a series of molds positioned in the casting basin.

BACKGROUND OF THE INVENTION

Vacuum-assisted countergravity casting methods, such as described in U.S. Pat. Nos. 3,900,064; 4,340,108 and 4,606,396, have been in use in the casting of a melt into a plurality of molds. Typically, the gas permeable molds are sealingly engaged in succession to a suitable vacuum housing and the underside of each mold so engaged to the vacuum housing is immersed in an underlying pool of the melt to countergravity cast the melt upwardly into the mold when a suitable differential pressure is established between the mold and the pool. A typical casting run may involve immersing approximately twenty (20) molds in the pool of the melt over a period of approximately five (5) minutes or more.

As the plurality of molds are cast from the common pool, the melt may become progressively contaminated with loose mold particulate and other foreign matter to an extent that may lead to production of unsatisfactory (dirty) castings and/or that may require replacement of the melt. Moreover, the casting process must be interrupted after a given number of molds (e.g., 20 molds) are cast to replenish the melt pool to the proper level for further casting. Periodic interruptions are thus required during the casting of a large number of molds (e.g., hundreds of molds) in a production run and adversely affect the economies of the production process. Still further, if the melt contains a fugitive alloyant, such as a volatile magnesium nodularizing agent in a grey iron melt, the concentration of the alloyant in the melt may decrease over the time period required to cast the plurality of molds from the common pool. For example, loss (or fade) of the volatile magnesium nodularizing agent from the iron melt can be as much as 0.075 w/o (i.e., weight percent) or more over the time required to cast the plurality of molds (e.g., twenty molds) from the common pool. Erratic, uncontrolled loss of the fugitive magnesium from the melt over time has been experienced and resulted in off-chemistry melts in so far as magnesium content is concerned and correspondingly inconsistent nodularization.

It is an object of the invention to provide an improved apparatus and method for the differential pressure, countergravity casting of a melt into a plurality of molds in such a manner that each mold is filled with an individual charge of the melt freshly admitted to a casting basin from a melt-holding chamber.

It is another object of the invention to provide an improved apparatus and method for the differential pressure, countergravity casting of a melt wherein each individual charge of the melt is admitted to the casting basin in an amount sufficient to cast only one of the molds such that the casting basin is supplied with a clean, fresh charge of the melt from the melt-holding chamber in order to cast the next mold.

It is another object of the invention to provide an improved apparatus and method for the differential pressure, countergravity casting of a melt into a plurality of molds wherein a fugitive alloyant (e.g., a magnesium nodularizing agent) is introduced into each individual charge in-situ in the casting basin just prior to casting each mold, thereby providing a freshly treated charge of melt for casting into each mold and substantially reducing loss (or fade) of the alloyant from the charge.

It is still another object of the invention to provide an improved apparatus and method for the differential pressure, countergravity casting of a melt wherein a large number of molds can be cast on a continual basis during a production run without major interruptions for melt replenishment.

SUMMARY OF THE INVENTION

The present invention contemplates an improved apparatus and method for the differential pressure, countergravity casting of a melt into a plurality of molds wherein a plurality of individual charges of the melt, each charge sufficient to cast only one mold, are admitted in succession to a casting basin from a melt-holding chamber in flow communication therewith. Each mold is immersed in a respective charge admitted to the casting basin and a sufficient differential pressure is established between each mold and the individual charge in which it is immersed to urge the charge upwardly from the casting basin into the mold to fill the mold cavity therein with the melt. Since the casting of each charge into each respective mold leaves insufficient charge in the casting basin to cast the next mold, the casting basin is then supplied with the next clean, fresh charge of melt from the melt-holding chamber for casting the next mold. In this way, each mold is filled with a fresh charge of the melt from the melt-holding chamber.

The melt-holding chamber can be supplied (replenished) with the melt from an adjacent melting vessel independently of admission of the individual charges from the melt-holding chamber to the casting basin such that a large number of molds can be cast on a continual basis without major interruptions heretofore experienced for replenishing a common melt pool.

In practicing the invention, a fugitive alloyant, such as a magnesium nodularizing agent, may be supplied to the casting basin prior to admission of each charge of the melt therein. Each charge admitted to the casting basin so contacts the alloyant as to have the alloyant introduced in-situ therein just prior to casting the next mold. In this way, each mold can be filled with a freshly treated (e.g., freshly nodularized) charge of the melt having a preselected effective concentration of the alloyant. Loss (or fade) of the fugitive alloyant heretofore experienced in the casting of a plurality of molds from a common pool of treated melt is thereby substantially reduced or eliminated. In the casting of nodular iron, the consistency of melt nodularization from one mold to the next is improved.

The aforementioned objects and advantages of the invention will become more fully apparent from the detailed description and drawings which follow.

BRIEF DESCRIPTION OF THE DRAWINGS

In FIG. 5, the vacuum housing is partially broken away to reveal the melt-filled mold therein.

DETAILED DESCRIPTION OF CERTAIN EMBODIMENTS

Figure 1:
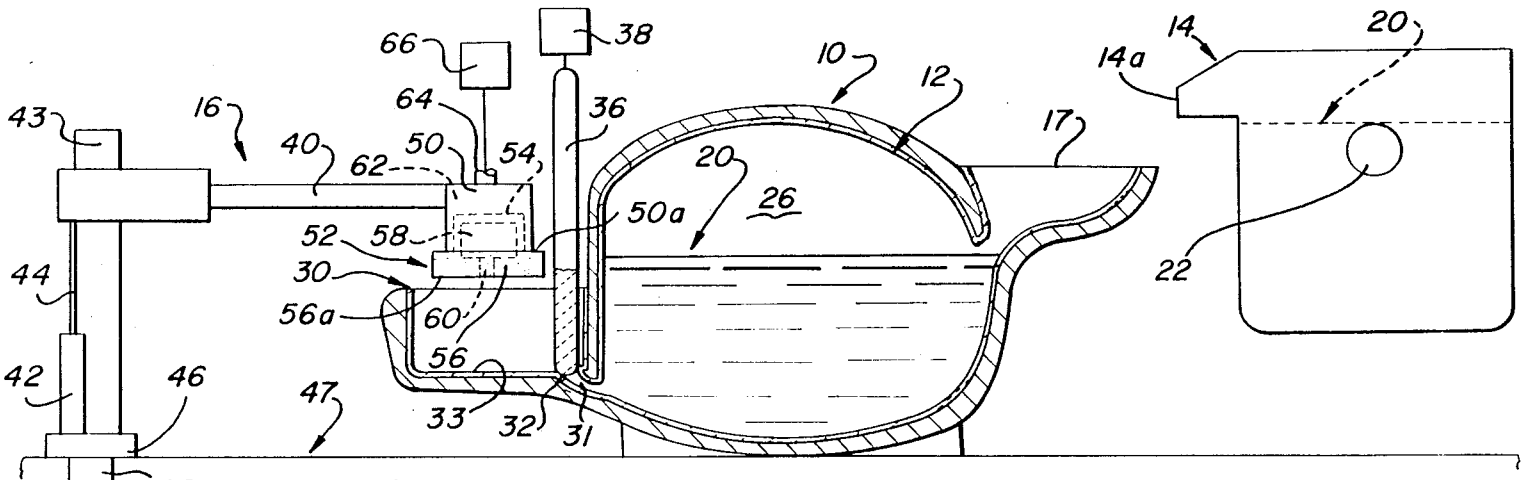
FIG. 1 is a schematic sectioned, side elevation of a casting apparatus in accordance with the invention.
Figure 2:
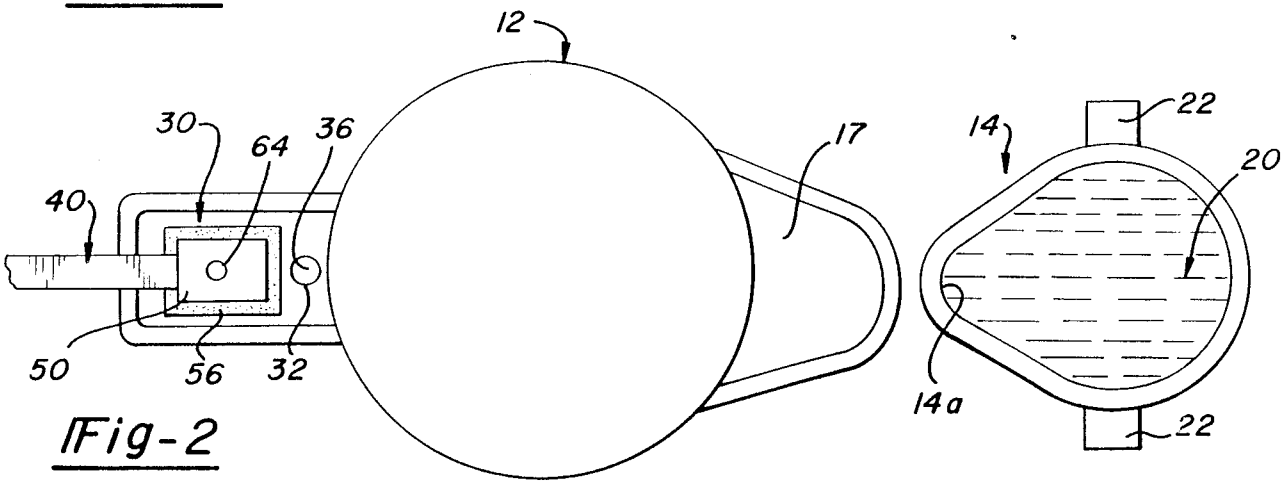
FIG. 2 is a schematic plan view of the apparatus of FIG. 1.

FIGS. 1 and 2 depict a differential pressure, countergravity casting apparatus 10 in accordance with one embodiment of the invention. The apparatus 10 comprises a centrally located, refractory lined vessel 12, a refractory lined melting vessel 14 (e.g., a melting furnace) disposed on one side of the central vessel 12 and a mold manipulator mechanism 16 disposed on the other side of the central vessel 12.

The melting furnace 14 is of conventional type for melting a charge of pig iron. Appropriate alloyant additions are made to the melted pig iron in the melting furnace 14 to provide a desired grey iron melt composition (substantially devoid of any carbon nodularizing agent). The melting furnace 14 includes trunnions 22 about which the melting furnace 14 is pivoted to pour the grey iron melt 20 from pour spout 14*a* through the fill opening 17 into the melt-holding chamber 26 of the vessel 12.

As shown best in FIG. 1, the melt-holding chamber 26 is in flow communication with an inlet 32 of a casting basin 30 disposed on the side of the vessel 12 adjacent the mold manipulator mechanism 16 via a lateral channel 31. The inlet 32 is disposed in the bottom wall 33 of the casting basin 30. A vertically movable, refractory stopper rod 36 is provided to open or close the inlet 32 to admit a preselected quantity of the melt 2 in the melt-holding chamber 26 to the casting basin 30 a will be explained hereinbelow. A conventional actuator 38 (shown schematically), such as a hydraulic actuator, is employed to raise or lower the stopper rod 36 relative to the inlet 32 to open or close it.

The melt 20 is maintained at a minimum level or height in the melt-holding chamber 26 to provide a metallostatic head sufficient to allow filling of the casting basin 3 when the stopper rod 36 is raised to open the inlet 32. The melt 20 is supplied to the melt-holding chamber 26 periodically from the melting vessel 14 as needed to maintain this minimum melt level in the chamber 26. Periodic supply of the melt 20 from the melting vessel 14 to the melt-holding chamber 26 can be accomplished independently of filling of the casting basin 30 with the melt.

Alternately or in addition to the metallostatic head effect, the melt 20 can also be caused to flow from the melt-holding chamber 26 to the casting basin 30 when the inlet 32 is open by suitable gas pressurization of the chamber 26 (depending upon the configuration of the melt-holding chamber 26 and its position relative to the casting basin 30; i.e., above or below the basin 30).

Although the fill opening 17, melt-holding chamber 26 and casting basin 30 are shown as integral to the vessel 12, the invention is not so limited. For example, separate components suitably interconnected in melt flow communication may be used to provide the fill opening 17, melt-holding chamber 26 and casting basin 30. Moreover, the vessel 12 may include a removable top (not shown) to provide access to the melt-holding chamber 26 and suitable heating means (not shown) to maintain the temperature of the melt 20 at the desired casting temperature.

The mold manipulating mechanism 16 is disposed adjacent the casting basin 30 and comprises a mold manipulator arm 40 disposed on a support post 43 for vertical movement by hydraulic cylinder 42 and associated piston 44 connected to the arm 40. The support post 43 is carried on a base 46 that is pivotable about a vertical axis by a rotary actuator 48. A vacuum housing 50 is carried on the outboard end of the manipulator arm 40 and includes a bottom lip 50*a* adapted to sealingly engage a casting mold 52 comprising an upper gas permeable cope 54 and a lower drag 56, which may be gas permeable or impermeable. As shown schematically, the cope 54 and drag 56 define therebetween a mold cavity 58 which is communicated to the underside 56*a* of the drag 56 by an ingate 60. Other types of casting molds, such as gas permeable investment shell molds, with single or multiple mold cavities can be used in practicing the invention.

The vacuum housing 50 defines a vacuum chamber 62 therein and includes a conduit 64 (partially shown) connected to a source 66 of vacuum (e.g., a vacuum pump) for evacuating the vacuum chamber 62 and thus the mold cavity 58 through the gas permeable cope 54. A manipulator mechanism of the type described hereinabove having a vacuum housing sealingly receiving a gas permeable casting mold is described in U.S. Pat. No. 4,340,108, the teachings of which are incorporated herein by reference.

In accordance with one embodiment of the invention for casting the grey iron melt 20 (as in-situ nodularized in the casting basin 30) into a plurality of molds 52 (only one shown), each of a plurality of individual charges 70 (e.g., see FIG. 4) of the grey iron melt 20 is admitted from the melt-holding chamber 26 to the casting basin 30 with each charge being sufficient in quantity or amount to fill only one mold 52. Each charge 70 is admitted to the casting basin 30 by raising the stopper rod 36 to open the inlet 32 and allow the grey iron melt 20 in the melt-holding chamber 26 to flow into the casting basin 30. Once the desired quantity of the clean, fresh grey iron melt 20 is admitted to the casting basin 30, the stopper rod 36 is lowered to close the basin inlet 32.

Figure 3:
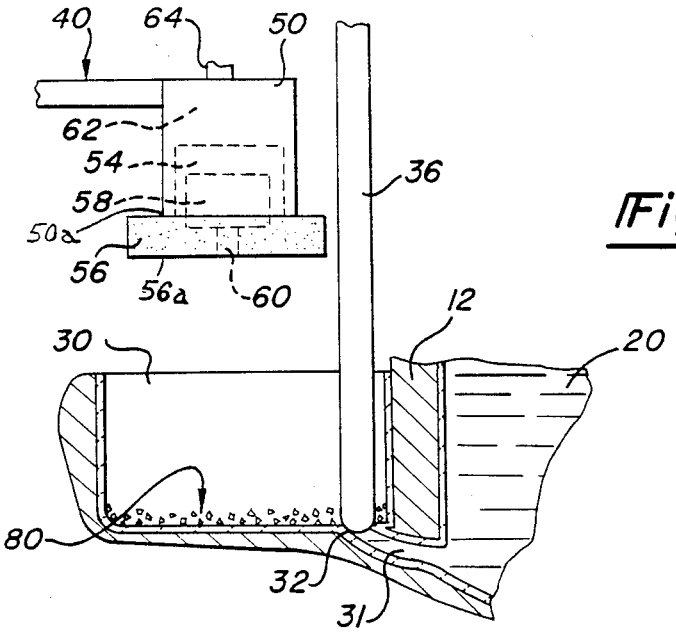
FIGS. 3, 4 and 5 are fragmentary sectioned, side elevations of the casting apparatus illustrating one embodiment of the method of the invention for casting a treated (nodularized) charge of melt into a gas permeable casting mold.

However, prior to the admission of each charge 70 of the melt 20 to the casting basin 30, a quantity (i.e., a charge) of a volatile (fugitive) carbon nodularizing agent 80 is supplied to the casting basin 30, FIG. 3. The nodularizing agent 80 typically comprises an iron-silicon-magnesium alloy (e.g., 5 weight percent Mg and the balance equal amounts of Fe and Si) and is supplied to the casting basin 30 in granular or other form and in a quantity sufficient to spherodize the carbon in each individual charge 70 of the melt 20 admitted to the casting basin 30.

In particular, as each individual charge 70 is admitted to the casting basin 30 (by opening inlet 32), the charge 70 contacts the nodularizing agent 80 (previously supplied to the casting basin 30) in such a manner as to dissolve the nodularizing agent therein for carbon nodularizing purposes. Typically, the magnesium concentration of each charge 70 in the casting basin 30 is controlled to be at least about 0.02 weight percent Mg and preferably about 0.03 to about 0.06 weight percent Mg to provide satisfactory nodularization of the carbon of each charge 70.

Figure 4:
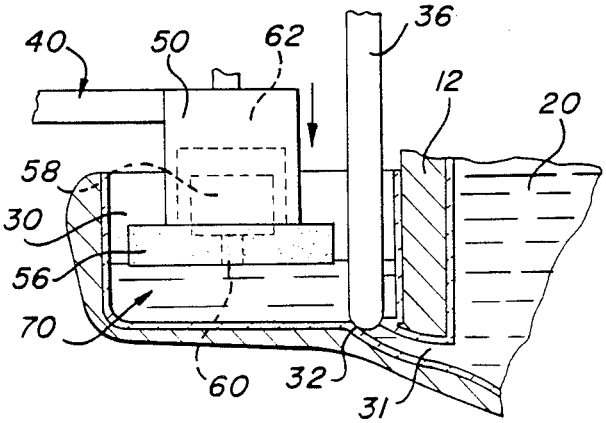
Figure 5:
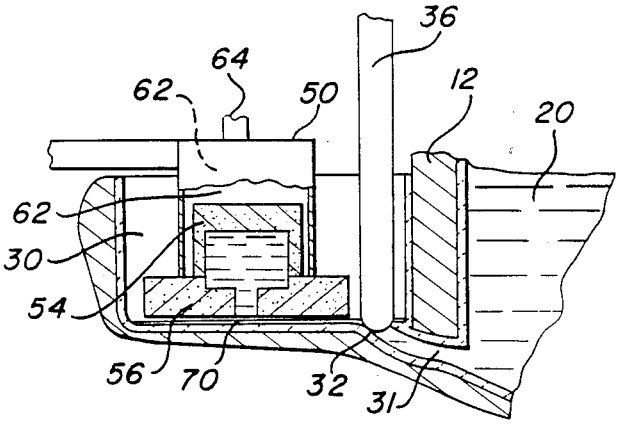

Once each charge 70 is nodularized in-situ in the casting basin 30, the manipulator arm 40 lowers the casting mold 52 (sealingly engaged to the vacuum housing 50) to immerse the underside 56*a* of the drag 56 in the freshly nodularized charge 70, FIG. 4, and thereby communicate the ingate 60 to the charge 70. The nodularized charge 70 is then urged upwardly through the ingate 60 into the mold cavity 58 by evacuating the vacuum chamber 62. In particular, the vacuum chamber 62 is evacuated to establish a sufficient differential pressure between the mold cavity 58 and the charge 70 in which the underside 56*a* is immersed to urge the charge upwardly into the mold cavity 58. As the nodularized charge 70 is urged upwardly, the mold 52 is lowered by the manipulator arm 40 to follow the falling level of the charge 70 in the casting basin 30. When the mold cavity 58 is filled with the nodularized charge 70, only a minor or minimal amount of the charge 70 will remain in the casting basin 30, FIG. 5, since the quantity of the charge 70 initially admitted is only just sufficient to fill one mold 52. As a result, the casting basin 30 is left in a near "dry" condition with insufficient charge 70 remaining to fill the next mold 52 to be cast.

After filling of the mold cavity 58 and solidification of the charge 70 at least in the ingate 60, the melt-filled mold 52 is raised above the near "dry" casting basin 30 (by manipulator arm 40) and then is rotated (by rotary actuator 48) to a demold station (not shown) where the melt-filled mold 52 is removed from the vacuum housing 50. The next empty mold 52 can then be sealingly engaged to the vacuum housing 50 in preparation for casting.

Since the casting basin 30 is now in a near "dry" state with insufficient melt to cast this next mold 52, the steps described hereinabove of supplying the charge of the nodularizing agent 80 to the casting basin 30 (e.g., see FIG. 3) and admitting a clean, fresh charge 70 of the base melt 20 from the melt-holding chamber 26 to the basin 30, FIG. 4, for in-situ nodularization in the basin 30 are repeated for the next mold 52. The next mold 52 can then be differential pressure, countergravity cast from the freshly nodularized charge 70 in the basin 30, again leaving the basin 30 in the near "dry" condition. The above-described sequence is then repeated as necessary to countergravity cast the next freshly nodularized charge 70 into the next mold 52 of a series (plurality) of molds after engagement of the mold with the vacuum housing 50.

In accordance with the invention, each mold 52 is thus filled with a clean, freshly nodularized charge 70 having an effective magnesium concentration for carbon nodularization purpose. Loss (or fade) of magnesium from each charge 70 to be cast into each mold 52 is thereby substantially reduced, if not eliminated, and more consistent carbon nodularization is provided from one mold 52 to the next in the series of molds 52 that are cast, regardless of the time required to cast the molds 52.

Moreover, by virtue of casting each fresh nodularized charge 70 into a respective one of the casting molds 52, any contamination of the charge 70 is confined primarily t the particular mold 52 being cast. Progressive contamination of a common pool of melt, as experienced heretofore in the prior art practice of countergravity casting, is thereby substantially reduced or avoided. Furthermore, any residual contamination in the casting basin 30 can be removed after each mold 52 is cast so that the next clean, fresh charge 70 admitted to the casting basin 30 from the melt-holding chamber 26 will not be adversely affected.

Furthermore, since the melt-holding chamber 26 can be periodically replenished with the melt 20 from the melting furnace 14 independently of filling the casting basin 30 with the individual charges 70, there is no need to interrupt the successive casting of the individual charges 70 into the molds 52 Supply of the nodularizing agent 80 and admission of the charges 70 of the melt 20 to the casting basin 30 can be coordinated with the immersion of each mold in a respective charge 70 to cast a large number of molds 52 on a continual basis during a production run without interruptions to replenish the melt in the melt-holding chamber 26.

Although the invention has been described in detail hereinabove with respect to the differential pressure, countergravity casting of nodular iron (nodularized grey iron), those skilled in the art will appreciate that the invention is not so limited and may find use in the differential pressure, countergravity casting of grey (unnodularized) iron. Casting of a grey iron melt would be practiced in the manner described hereinabove without, however, the need to supply the nodularizing agent 80 to the casting basin 30 prior to the admission of each charge 70 of the grey iron melt 20 to the casting basin 30 from the melt-holding chamber 26. The invention will also prove useful and advantageous in the casting of other metals and alloys as well, especially those that contain or are treated with a fugitive alloyant that is rapidly lost from the melt for one reason or another over time and where there is a need to maintain an effective concentration of the alloyant in the melt.

While the invention has been described in terms of specific embodiments thereof, it is not intended to be limited thereto but rather only to the extent set forth hereafter in the claims which follow.

We claim:

1. Apparatus for the differential pressure, countergravity casting of a melt into a plurality of casting molds, comprising:

(a) vessel means including a melt-holding chamber, a casting basin in flow communication with the melt-holding chamber and means for admitting a plurality of charges of the melt in succession from the chamber to the casting basin, each charge being of a selected amount sufficient to cast only one of the molds, (b) means for immersing each mold in a respective one of the charges of the melt admitted to the casting basin, and (c) means for establishing a sufficient differential pressure between each mold and the charge in which it is immersed to draw the charge upwardly from the casting basin into each mold, leaving the casting basin with insufficient charge to cast the next mold, whereupon the casting basin is then supplied with the next charge of the melt for casting the next mold of the plurality of molds.

2. The apparatus of claim 1 further comprising means for supplying an alloyant to the casting basin prior to admitting each charge of the melt thereto such that each charge so contacts the alloyant as to have the alloyant introduced in-situ therein in the casting basin.

3. The apparatus of claim 1 wherein the means for admitting the plurality of charges of the melt from the chamber to the casting basin comprises a stopper rod movable relative to a molten metal inlet to the casting basin to open or close said inlet.

4. The apparatus of claim 3 wherein said inlet is disposed in a bottom wall of the casting basin and said stopper rod is vertically movable to open or close the inlet.

5. The apparatus of claim 1 wherein the means for immersing each mold in a respective one of the charges of the melt comprises a vertically movable manipulator arm for lowering each mold toward the casting basin to immerse each mold in the charge therein and then raising each mold from the casting basin after the charge is cast into the mold.

6. The apparatus of claim 1 wherein the vessel means further includes a fill opening in communication with the melt-holding chamber for receiving the melt from a melting vessel.

7. The apparatus of claim 6 wherein the fill opening is disposed on a side of the vessel means opposite from the casting basin.

8. Apparatus for the differential pressure, countergravity casting of a nodular iron melt into a plurality of molds, comprising:

(a) vessel means including a chamber for holding molten iron substantially devoid of a nodularizing agent, a casting basin in flow communication with the chamber and means for admitting a plurality of charges of the melt in succession from the chamber to the casting basin, each charge being of a selected amount sufficient to cast only one of the molds, (b) means for supplying a sufficient charge of a carbon nodularizing agent to the casting basin prior to admission of each charge of melt therein so as to nodularize each charge of the melt in-situ in said casting basin, (c) means for immersing each mold in a respective one of the nodularized charges in the casting basin, and (d) means for establishing a sufficient differential pressure between each mold and the nodularized charge in which it is immersed to draw the nodularized charge upwardly from the casting basin into each mold, leaving the casting basin with insufficient nodularized charge to cast the next mold, whereupon the casting basin is then supplied with the next charge of the nodularizing agent followed by the next charge of the melt for casting the next mold of the plurality of molds.

9. A method for the differential pressure countergravity casting of a melt into a plurality of casting molds, comprising the steps of:

(a) holding the melt in a melt-holding chamber, (b) admitting a charge of the melt from the chamber to a casting basin that is in flow communication therewith in a selected amount sufficient to cast only one of the molds, (c) differential pressure, countergravity casting one of the molds from the charge in the casting basin, leaving insufficient charge in the casting basin to cast the next mold, and (d) repeating steps (b) and (c) to countergravity cast the next charge of the melt into the next mold of the plurality of molds.

10. The method of claim 9 further including supplying an alloyant to the casting basin prior to admission of the charge therein such that said charge so contacts the alloyant as to have said alloyant introduced in-situ therein in the casting basin.

11. A method for the differential pressure, countergravity casting of nodular molten iron into a plurality of casting molds, comprising the steps of:

(a) holding a molten iron melt substantially devoid of nodularizing agent in a melt-holding chamber, (b) supplying a charge of a nodularizing agent to a casting basin that is in flow communication with the chamber, said charge of the nodularizing agent being sufficient to nodularize a charge of the iron melt of an amount selected to fill only one of the molds, (c) admitting the charge of the iron melt from the chamber to the casting basin such that the charge contacts said nodularizing agent and is nodularized in-situ in the casting basin, (d) differential pressure, countergravity casting one of the molds from the nodularized charge in the casting basin, leaving insufficient nodularized charge in the casting basin to cast the next mold, and (e) repeating steps (b), (c) and (d) to countergravity cast the next nodularized charge into the next mold of the plurality of molds.

* * * * *

UNITED STATES PATENT AND TRADEMARK OFFICE

CERTIFICATE OF CORRECTION

PATENT NO. : 4,977,946

DATED : December 18, 1990

INVENTOR(S) : Eugene W. Borrousch et al.

It is certified that error appears in the above-identified patent and that said Letters Patent is hereby corrected as shown below:

Column 3, line 38, delete "2" and insert --20-- therefor.

Column 3, line 39, delete "a" and insert --as-- therefor.

Column 3, line 47, delete "3" and insert --30-- therefor.

Column 5, line 64, delete "t" and insert --to-- therefor.

Column 6, line 10, after "52" insert --.-- .

Signed and Sealed this

Tenth Day of August, 1993

Attest:

Michael K. Kirk

MICHAEL K. KIRK

Attesting Officer

Acting Commissioner of Patents and Trademarks